US008459754B2

(12) United States Patent
Cho et al.

(10) Patent No.: US 8,459,754 B2
(45) Date of Patent: Jun. 11, 2013

(54) WASHING MACHINE

(75) Inventors: Cheon-Soo Cho, Gyeongsangnam-Do (KR); Hyuk-Soo Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/933,165

(22) PCT Filed: Mar. 13, 2009

(86) PCT No.: PCT/KR2009/001263

§ 371 (c)(1),
(2), (4) Date: Sep. 17, 2010

(87) PCT Pub. No.: WO2009/116752

PCT Pub. Date: Sep. 24, 2009

(65) Prior Publication Data

US 2011/0018408 A1 Jan. 27, 2011

(30) Foreign Application Priority Data

Mar. 19, 2008 (KR) ..... 10-2008-0025583

(51) Int. Cl.
*A47B 77/00* (2006.01)
*E05F 1/14* (2006.01)

(52) U.S. Cl.
USPC ..... 312/228; 16/285; 16/307

(58) Field of Classification Search
USPC ..... 312/319.2, 228, 328, 326, 327, 8.15, 312/26, 30; 16/306, 307, 285, 289, 54; 68/196; 49/386, 327
See application file for complete search history.

(56) References Cited

U.S. PATENT DOCUMENTS 1,515,413 A * 11/1924 Roberts et al. ..... 126/194
1,892,584 A * 12/1932 Olson ..... 16/307
2,335,328 A * 11/1943 Whitehead ..... 49/386
2,538,679 A * 1/1951 Foltis ..... 16/68
2,755,500 A * 7/1956 Floehr ..... 16/76

(Continued)

FOREIGN PATENT DOCUMENTS

CN 2718015 Y 8/2005
JP 2000-342893 A 12/2000

(Continued)

OTHER PUBLICATIONS

Machine Translation, Registered Utility Model, Registration Publication No. KR 20-03877961.*

*Primary Examiner* — James O Hansen
*Assistant Examiner* — Kimberley S Wright
(74) *Attorney, Agent, or Firm* — Birch, Stewart, Kolasch & Birch, LLP

(57) ABSTRACT

A washing machine comprises a casing, a top cover installed on an upper surface of the casing, a door installed at the top cover, through which laundry is accommodated into the casing, and a tub installed in the casing, wherein the door is connected to the top cover by a hinge assembly or a damper assembly provided thereat. The hinge assembly includes a first hinge portion, and a second hinge portion having a torsion spring therein. The damper assembly includes a first damper portion, a second damper portion, and a ring member having a round shape and fitted into an outer circumferential surface of the second damper portion. Accordingly, even when the door has a heavy weight due to its material of a reinforcing glass, the hinge assembly or the damper assembly can endure the weight of the door. This may prevent noise or impact occurring when the door is closed.

11 Claims, 3 Drawing Sheets

U.S. PATENT DOCUMENTS

| | | | | | |
|---|---|---|---|---|---|
| 2,904,853 | A | * | 9/1959 | Devery | 49/386 |
| 2,929,093 | A | * | 3/1960 | Conlee | 16/338 |
| 2,982,540 | A | * | 5/1961 | Eppley et al. | 49/277 |
| 3,335,454 | A | * | 8/1967 | Danster, Jr. | 16/278 |
| 3,459,462 | A | * | 8/1969 | Barnard et al. | 312/228 |
| 4,115,901 | A | * | 9/1978 | Schmidt | 16/374 |
| 4,485,522 | A | * | 12/1984 | Chen | 16/54 |
| 4,697,302 | A | * | 10/1987 | Yuenian | 16/52 |
| 4,731,905 | A | * | 3/1988 | Milano et al. | 16/306 |
| 4,788,746 | A | * | 12/1988 | Idler | 16/297 |
| 4,914,781 | A | * | 4/1990 | Sokn et al. | 16/225 |
| 4,947,516 | A | * | 8/1990 | Kretchman et al. | 16/289 |
| 5,028,913 | A | * | 7/1991 | Kitamura | 361/679.27 |
| 5,037,231 | A | * | 8/1991 | Kitamura | 403/120 |
| 5,041,818 | A | * | 8/1991 | Liu | 361/679.27 |
| 5,109,571 | A | * | 5/1992 | Ohshima et al. | 16/307 |
| 5,219,240 | A | * | 6/1993 | Kitamura | 403/84 |
| 5,240,319 | A | * | 8/1993 | Koga | 312/319.2 |
| 5,419,013 | A | * | 5/1995 | Hsiao | 16/319 |
| 5,671,500 | A | * | 9/1997 | Balk | 16/72 |
| 5,855,040 | A | * | 1/1999 | Lin | 16/50 |
| 5,894,633 | A | * | 4/1999 | Kaneko | 16/306 |
| 5,943,738 | A | * | 8/1999 | Karfiol | 16/342 |
| 6,070,293 | A | * | 6/2000 | Schreiber | 16/229 |
| 6,336,252 | B1 | * | 1/2002 | Bando | 16/307 |
| 6,532,628 | B2 | * | 3/2003 | Kim | 16/342 |
| 6,679,572 | B2 | * | 1/2004 | Sears | 312/319.2 |
| 6,708,046 | B1 | * | 3/2004 | Takagi | 455/575.3 |
| 6,748,625 | B2 | * | 6/2004 | Lu | 16/285 |
| 6,789,293 | B2 | * | 9/2004 | Habegger et al. | 16/343 |
| 6,829,807 | B2 | * | 12/2004 | Kim | 16/322 |
| 6,922,869 | B2 | * | 8/2005 | Bivens et al. | 16/54 |
| 7,416,093 | B2 | * | 8/2008 | Lin et al. | 220/254.5 |
| 8,060,985 | B2 | * | 11/2011 | Lin | 16/374 |
| 8,096,020 | B2 | * | 1/2012 | Tang | 16/337 |
| 8,104,142 | B2 | * | 1/2012 | Lowry et al. | 16/307 |
| 2002/0194704 | A1 | * | 12/2002 | Snowden et al. | 16/260 |
| 2005/0097705 | A1 | * | 5/2005 | Chen | 16/326 |
| 2005/0246863 | A1 | * | 11/2005 | Chesworth et al. | 16/221 |
| 2005/0246864 | A1 | * | 11/2005 | Arakawa | 16/277 |
| 2006/0096064 | A1 | * | 5/2006 | Ma et al. | 16/303 |
| 2006/0175331 | A1 | * | 8/2006 | Lin et al. | 220/254.5 |
| 2007/0091387 | A1 | * | 4/2007 | Kakuta | 358/498 |
| 2008/0295544 | A1 | * | 12/2008 | Cho et al. | 68/12.26 |
| 2009/0007380 | A1 | * | 1/2009 | Feng et al. | 16/305 |
| 2009/0106938 | A1 | * | 4/2009 | Mori | 16/277 |
| 2009/0260187 | A1 | * | 10/2009 | Wang et al. | 16/307 |
| 2010/0205778 | A1 | * | 8/2010 | Duan et al. | 16/386 |
| 2010/0313384 | A1 | * | 12/2010 | Nakasone | 16/277 |

FOREIGN PATENT DOCUMENTS

| | | | | |
|---|---|---|---|---|
| JP | 2008-272034 | A | | 11/2008 |
| JP | 3147032 | | * | 12/2008 |
| KR | 10-2000-0002677 | A | | 1/2000 |
| KR | 2000-0001106 | A | | 1/2000 |
| KR | 10-0403161 | B1 | | 11/2003 |
| KR | 20-0387961 | Y1 | | 6/2005 |
| WO | WO 2007106077 | A2 | * | 9/2007 |

* cited by examiner

WASHING MACHINE

TECHNICAL FIELD

The present invention relates to a washing machine, and particularly, to a washing machine having a hinge assembly or a damper assembly capable of reducing noise or vibration due to collision occurring between a door and a top cover when the door is opened or closed.

BACKGROUND ART

Generally, a washing machine for washing or drying laundry such as clothes is largely divided into two types according to a rotation shaft of a drum. A washing machine having a vertical rotation shaft is called as top loading washing machine, whereas a washing machine having a horizontal rotation shaft is called as front loading washing machine or drum washer.

The washing machine is provided with a door through which laundry is accommodated therein. The door is mounted to a casing or a top cover of the washing machine by a hinge. The hinge for the conventional washing machine has a complicated structure, and has a difficulty in being detachably mounted to the washing machine.

DISCLOSURE OF INVENTION

1. Technical Problem

In the case of the top loading washing machine, the hinge does not sufficiently attenuate an impact occurring when the door is upwardly opened or closed. This may cause noise, or may badly influence on the durability of the washing machine. Especially, when the door has a heavy weight due to its material of a reinforcing glass, the hinge does not endure the weight of the door thus not to attenuate an impact occurring when the door is closed. Besides, in the case of that the door is fabricated to have a thin thickness for a large washing machine, the hinge has a limitation to have a sufficient strength.

2. Technical Solution

Therefore, it is an object of the present invention to provide an object of the present invention is to provide a washing machine having a damping means capable of reducing an impact occurring when a door in a closing operation collides with a top cover, and capable of reducing noise.

Another object of the present invention is to provide a washing machine having a damping means applicable even when a door is fabricated to have a thin thickness.

To achieve these and other advantages and in accordance with the purpose of the present invention, as embodied and broadly described herein, there is provided a washing machine, comprising: a casing; a top cover installed on an upper surface of the casing; a door installed at the top cover, through which laundry is accommodated into the casing; and a tub installed in the casing, wherein the door is connected to the top cover by a hinge assembly or a damper assembly provided thereat.

Accordingly, even when the door has a heavy weight due to its material of a reinforcing glass, the hinge assembly or the damper assembly can endure the weight of the door. This may prevent noise or impact occurring when the door is closed or opened.

The hinge assembly is composed of a first hinge portion, and a second hinge portion having a torsion spring therein. The first hinge portion is insertion-fixed to the top cover, and the second hinge portion is inserted into the door. And, the door can perform a relative rotation with respect to the second hinge portion.

The second hinge portion is preferably formed in a cylindrical shape having a cavity therein. Spring fixing holes and slots are penetratingly formed on an outer circumferential surface of the second hinge portion. The slots are formed on the outer circumferential surface of the second hinge portion with constant intervals therebetween in a circumferential direction.

End portions of a torsion spring are inserted into the spring fixing hole and the slot of the second hinge portion, respectively. One end of the torsion spring having been inserted to the slot is extending from the slot, and moves along the slot. However, another end of the torsion spring having been inserted into the spring fixing hole is fixed. One end of the torsion spring having been inserted into the slot performs a sliding motion along the slot when the door is opened and closed. When the door is opened, one end of the torsion spring having been inserted into the slot is located at one end of the slot. However, when the door is closed, said one end of the torsion spring is located at another end of the slot.

Here, the slot is formed to have a length corresponding to an opened state and a closed state of the door, respectively. One end of the slot may serve as a stopper to determine an opened degree of the door. More concretely, another end of the torsion spring positioned at another end of the slot moves along the slot when the door starts to be opened. And, when the door is completely opened, one end of the torsion spring is positioned at one end of the slot, thereby serving as a stopper that prevents the door from being opened.

When one end of the torsion spring is positioned at one end of the slot, the torsion spring is in an equilibrium state. However, the torsion spring may perform a damping operation by generating a torque when the door is closed, thereby having a controllable damping force.

The torsion spring is formed in one or more in number, and each of the spring fixing hole and the slot is also formed in one or more in number. Preferably, one torsion spring is inserted into one spring fixing hole and one slot. When the door is formed to have a thin thickness, the torsion spring mounted to the door has a limited size. Accordingly, an elastic force of the torsion spring may not be sufficient enough to damp an impact of the door. In this case, the torsion spring may obtain a sufficient elastic force by being implemented in plurality.

The washing machine is provided with a damper assembly having a first damper portion, and a second damper portion inserted into the door. And, an accommodating portion for accommodating the second damper portion therein is formed at the door.

Since not only the hinge assembly but also the damper assembly are provided, noise or impact occurring when the door having a heavy weight is closed may be effectively prevented by using a damping force from the damper assembly. Preferably, the second damper portion has a circular sectional surface, whereas the first damper portion has a polygonal sectional surface.

As well as the first damper portion and the second damper portion, the damper assembly further includes a ring member having a round shape and fitted into an outer circumferential surface of the second damper portion. In this case, the door is provided with an accommodating portion for accommodating therein the second damper portion and the ring member.

Under these configurations, the ring member is forcibly-fitted into the accommodating portion of the door. And, a part for generating a damping force by contacting the accommodating portion of the door may have an increased diameter owing to the ring member. This may allow a larger damping force to be obtained.

Preferably, the second damper portion has a circular or polygonal sectional surface, and a central portion of the ring member has a circular or polygonal sectional surface in correspondence to the sectional shape of the second damper portion. And, the ring member preferably has a circular outer circumference.

A coupling force between the ring member and the second damper may be increased, by fitting the ring member formed to have a polygonal sectional surface into the second damper portion formed to have a polygonal sectional surface. Preferably, the ring member is provided in one or more in number, and is formed of polyurethane or rubber for a sufficient damping force.

Preferably, the first damper portion of the damper assembly is inserted into the top cover, whereas the second damper portion is inserted into the door.

More preferably, each of the hinge assembly and the damper assembly is provided in plurality in number, and the plurality of hinge assemblies and damper assemblies are coupled to one another on the same shaft.

This structure is implemented in order to obtain a larger damping force, by combing the hinge assemblies with the damper assemblies when the torsion spring of the hinge assembly has a small elastic force. Here, the plurality of hinge assemblies and damper assemblies may be serially connected to one another.

For instance, may be constructed a combination of 'hinge assembly-damper assembly-hinge assembly' or a combination of 'damper assembly-hinge assembly-damper assembly'.

Advantageous Effects

The washing machine of the present invention has the following advantages.

Since the door is connected to the top cover by the hinge assembly and the damper assembly, may be reduced an impact and noise occurring when the door in a closing operation collides with the top cover. Furthermore, the hinge assembly and the damper assembly can be attached to the door even when the door is formed of a thin material. Accordingly, when the door is formed of a heavy and thin material, the hinge assembly and the damper assembly may attenuate an impact more effectively.

MODE FOR THE INVENTION

Reference will now be made in detail to the preferred embodiments of the present invention, examples of which are illustrated in the accompanying drawings.

Figure 1:
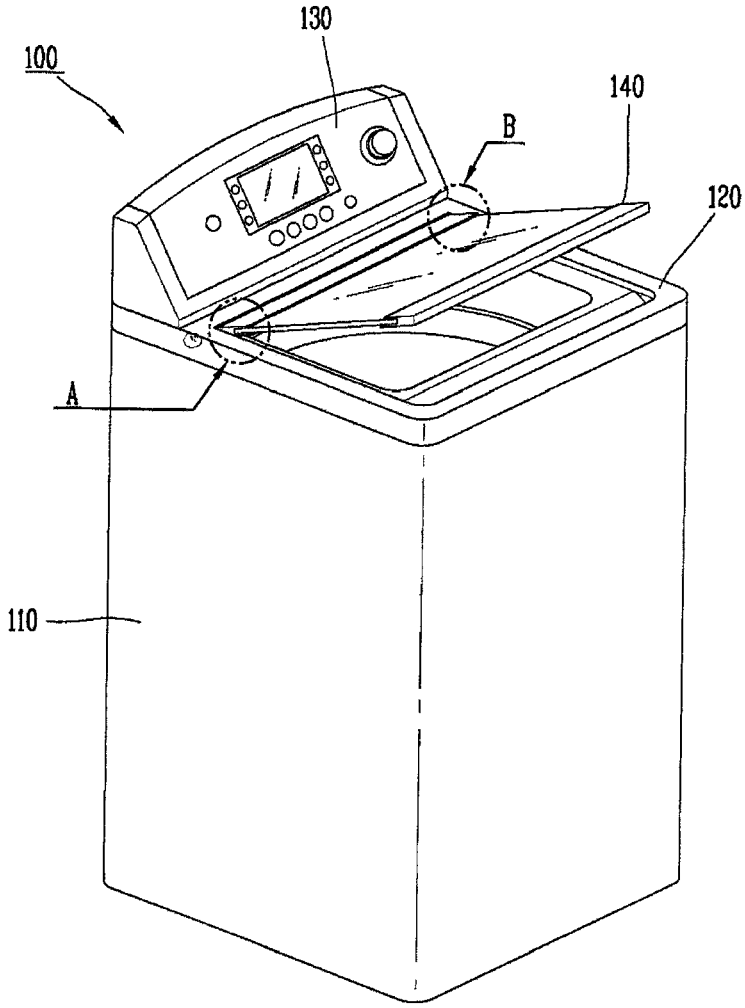
FIG. 1 is a perspective view schematically showing a washing machine according to the present invention.

FIG. 1 is a perspective view schematically showing a washing machine according to the present invention.

Referring to FIG. 1, a washing machine 100 of the present invention comprises a casing 110, a top cover 120 installed on an upper surface of the casing 110; a door 140 installed at the top cover 120, through which laundry is introduced into the casing 110; and a tub (not shown) installed in the casing 110 for accommodating laundry therein, wherein the door 140 is connected to the top cover 120 by a hinge assembly or a damper assembly provided thereat.

A control panel 130 for selecting an operation mode, etc. of the washing machine is protruding from an upper rear portion of the casing 110. The control panel 130 may be formed at an upper front portion of the casing 110. The door 140 shown in FIG. 1 has an entirely flat shape. However, the door 140 may be configured to have a structure that a middle portion thereof is folded when being opened. The door 140 may be formed of an opaque homogeneous material, or a transparent material that is capable of allowing a user to view a laundry state inside the washing machine. For a sufficient strength, the door 140 is formed of a reinforcing glass. In order to prevent the door 140 from having a heavy weight, and to obtain a space for mounting the hinge assembly 200 or the damper assembly 300, a molding material is preferably applied to a part where the hinge assembly 200 or the damper assembly 300 is mounted. That is, the door 140 according to one embodiment of the present invention is formed of a mixture between a reinforcing glass and a molding material.

The door 140 is mounted to the top cover 120 by the hinge assembly 200 or the damper assembly 300. Occasionally, the door 140 may be mounted to the casing 110 of the washing machine 100.

Figure 2:
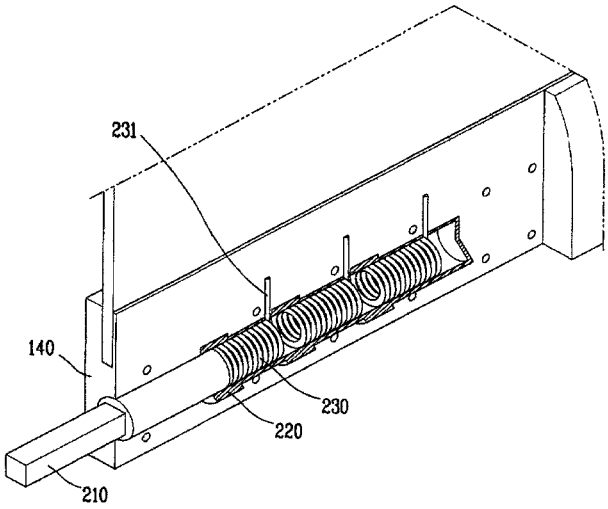
FIG. 2 is a detailed view of a part 'A' of FIG. 1.
Figure 3:
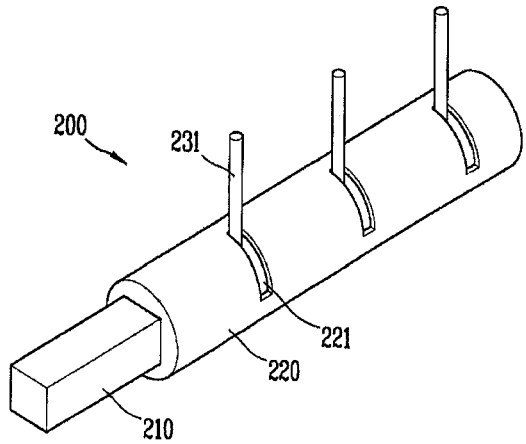
FIG. 3 is a perspective view showing one side of a hinge assembly of FIG. 2.
Figure 4:
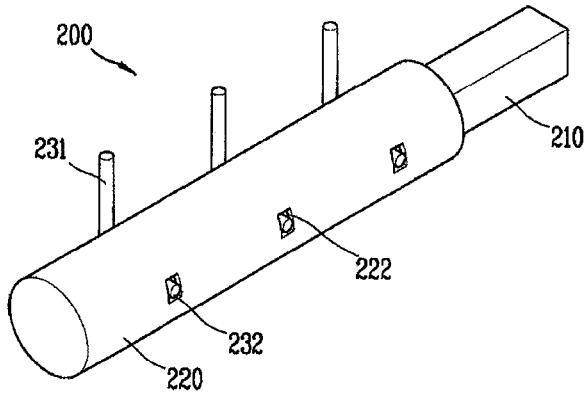
FIG. 4 is a perspective view showing another side of the hinge assembly of FIG. 2.

FIGS. 2 to 4 are perspective views showing the hinge assembly 200. The hinge assembly 200 is composed of a first hinge portion 210 and a second hinge portion 220. The second hinge portion 220 is provided with a torsion spring 230 therein. The first hinge portion 210 is insertion-fixed to the top cover 120, and the second hinge portion 220 is rotatably inserted into the door 140. That is, the door 140 can perform a relative rotation with respect to the second hinge portion 220.

The first hinge portion 210 insertion-fixed to the top cover 120 preferably has a rectangular sectional surface. However, the first hinge portion 210 may have various sectional surfaces. Preferably, the second hinge portion 220 is formed in a cylindrical shape having a cavity therein. The torsion spring 230 is inserted into the cavity of the second hinge portion 220. Spring fixing holes 222 and slots 221 for locating the torsion springs 230 inserted into the second hinge portion 220 are formed on an outer circumferential surface of the second hinge portion 220.

The spring fixing holes 222 and the slots 221 are penetratingly formed on an outer circumferential surface of the second hinge portion 220 from the cavity. And, the slots 221 serving as main components of the hinge assembly are formed on the outer circumferential surface with constant intervals therebetween. Each of the slots 221 is formed to have a width a little larger than an outer diameter of the torsion spring 230, thereby facilitating motion of the torsion spring 230 inserted thereinto.

Referring to FIG. 4, one end 231 of the torsion spring 230 is long protruding. More concretely, one end 231 of the torsion spring 230, which is long protruding out, is inserted into the slot 221 of the second hinge portion 220. And, another end 232 of the torsion spring 230 is insertion-fixed to the spring fixing hole 222. Here, the torsion spring 230 is fixed to the spring fixing hole 222 as another end thereof is a little protruding from the spring fixing hole 222.

The one end 231 of the torsion spring 230 inserted into the slot 221 penetrates the slot 221 thus to be insertion-fixed to the door 140. Accordingly, the one end 231 of the torsion spring 230 is integrally rotated with the door 140. Under these configurations, when the door 140 rotates centering around a hinge shaft by being opened and closed, the one end 231 of the torsion spring 230 moves along the slot 221 formed on the outer circumferential surface of the second hinge portion 220.

More specifically, when the door 140 is completely opened, the one end 231 of the torsion spring 230 is positioned at one end of the slot 221 (refer to FIG. 3). However, when the door 140 is completely closed, the one end 231 of the torsion spring 230 is positioned at another end of the slot 221. That is, the torsion spring 230 protruding from the slot 221 has its one end 231 moved along the slot 221 when the door 140 is opened. If the door 140 is completely opened, the one end 231 of the torsion spring 230 is positioned at one end of the slot 221, thus not to be moved any longer.

Since one end of the slot 221 serves as a stopper that determines an opened position of the door 140, the washing machine of the present invention does not require an additional stopper for the door.

Under a state that the door 140 is completely opened, the torsion spring 230 connected to the door 140 is configured to be in an equilibrium state. Accordingly, as the door is closed by being rotated, the torsion spring 230 generates a torque due to its elastic repulsive force. As the torque is transmitted to the door, the door has a damping force. The torsion spring 230 connected to the door 140 may be configured to generate a large torque when the door 140 is completely opened. In this case, the torsion spring 230 may generate a much larger torque as the door 140 is closed. Owing to this torque, a damping operation may occur.

According to another embodiment of the present invention, the torsion spring 230 is preferably formed in plurality in number, and each of the spring fixing hole 222 and the slot 221 is also formed in plurality in number. Accordingly, one torsion spring 230 is inserted into one spring fixing hole and one slot.

As the torsion spring 230 is implemented in plurality in number, a sufficient elastic force may be provided even if the torsion spring 230 has a small diameter. More concretely, the door 140 formed of a thin material may have a limited number of the torsion springs 230 inserted thereinto. Accordingly, one torsion spring 230 may be inserted into the door 140 thus not to generate a sufficient elastic force. In this case, a plurality of the torsion springs 230 are serially attached to the door 140, thereby providing a large elastic force.

Figure 5:
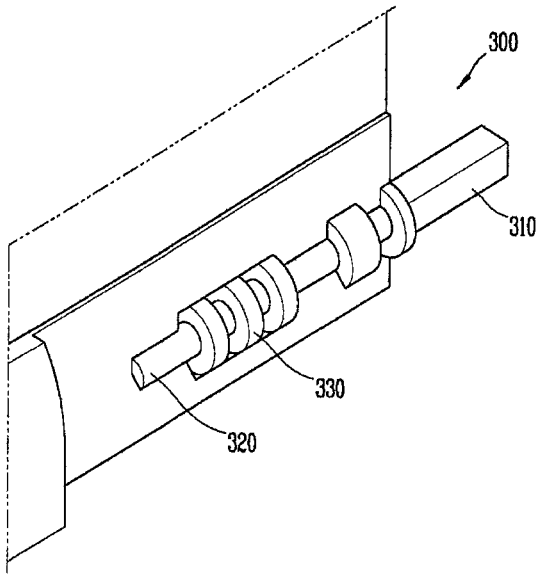
FIG. 5 is a detailed view of a part 'B' of FIG. 1.

Referring to a part of 'B' of FIG. 1, the door 140 of the washing machine according to the present invention may be connected to the top cover 120 by the damper assembly 300. FIG. 5 is a detailed view of the part 'B' of FIG. 1, which shows the damper assembly 300.

The damper assembly 300 is composed of a first damper portion 310, and a second damper portion 320. The second damper portion 320 is inserted into the door 140. And, an accommodating portion for accommodating the second damper portion 320 therein is formed at the door 140. The second damper portion 320 has a circular or polygonal sectional surface, and the first damper portion 310 has a polygonal sectional surface.

The first damper portion 310 is insertion-fixed to the top cover 120, and the second damper portion 320 is forcibly-fitted into the accommodating portion of the door 140. Under these configurations, when the door 140 is opened and closed by being rotated based on the damper assembly 300, the first damper portion 310 insertion-fixed to the top cover 120 is not rotated, and the second damper portion 320 connected to the first damper portion 310 is not rotated, either. This may result in a frictional force for preventing rotation of the door 140 between the second damper portion 320 and the accommodating portion of the door 140. Due to a damping force resulting from the frictional force, the door 140 has a low rotation speed when being opened and closed. This may reduce an impact or noise occurring when the door is closed.

The damping force may be controlled by selecting a proper material of the second damper portion 320 so that a proper frictional force can be generated between the second damper portion 320 and the accommodating portion of the door 140, or by controlling a degree that the second damper portion 320 is forcibly-fitted into the accommodating portion of the door 140.

As well as the first damper portion 310 and the second damper portion 320, the damper assembly 300 may further include a ring member 330 having a round shape and fitted into an outer circumferential surface of the second damper portion 320. In this case, the door 140 is provided with an accommodating portion for accommodating therein the second damper portion 320 and the ring member 330.

In the case that the second damper portion 320 further includes the ring member 330, a damping force required to control the speed of the door 140 being opened and closed results from a frictional force between the ring member 330 and the accommodating portion of the door 140 contacting the ring member 330. By increasing an outer diameter of the ring member 330, a large damping force may be obtained. Furthermore, as the ring member 330 is provided in plurality in number, a sufficient damping force may be obtained.

In the above descriptions, both the second damper portion 320 and the ring member 330 are formed to have round sectional surfaces. However, it may be constructed that the ring member 330 has a circular sectional surface, whereas the second damper portion 320 has a polygonal sectional surface. That is, the second damper portion 320 has a circular or polygonal sectional surface, and a central portion of the ring member 330 fitted into the second damper portion 320 has a circular or polygonal sectional surface in correspondence to the sectional shape of the second damper portion 320. And, the ring member 330 preferably has a circular outer circumference. Preferably, the ring member 330 is formed of polyurethane or rubber, thereby sufficiently obtaining a frictional force between the accommodating portion of the door 140 and the ring member 330.

Figure 6:
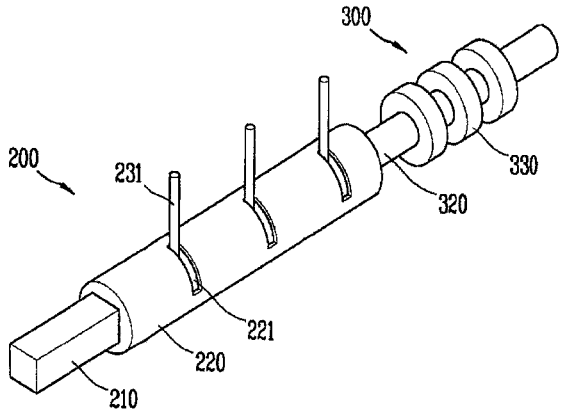
FIG. 6 is a perspective view showing a coupled state between a hinge assembly and a damper assembly.

FIG. 6 is a perspective view showing a coupled state between a hinge assembly and a damper assembly.

Referring to FIG. 6 according to another embodiment of the present invention, each of the hinge assembly 200 and the damper assembly 300 may be provided in plurality in number, and the plurality of hinge assemblies 200 and damper assemblies 300 may be serially coupled one another on the same shaft.

Figure 7:
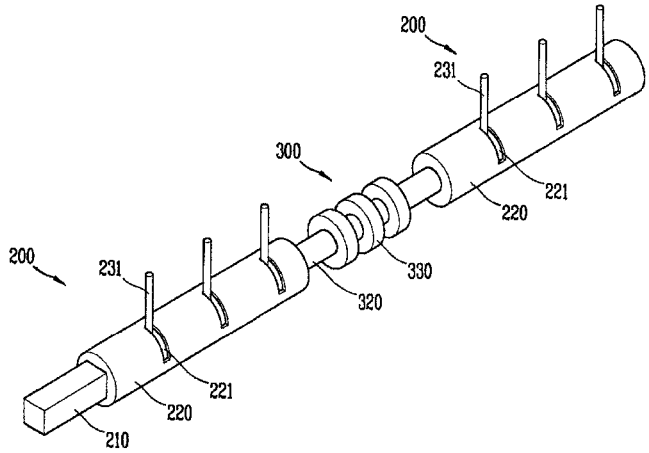
FIG. 7 is a perspective view showing a state that two hinge assemblies are coupled to each other with a damper assembly interposed therebetween.
Figure 8:
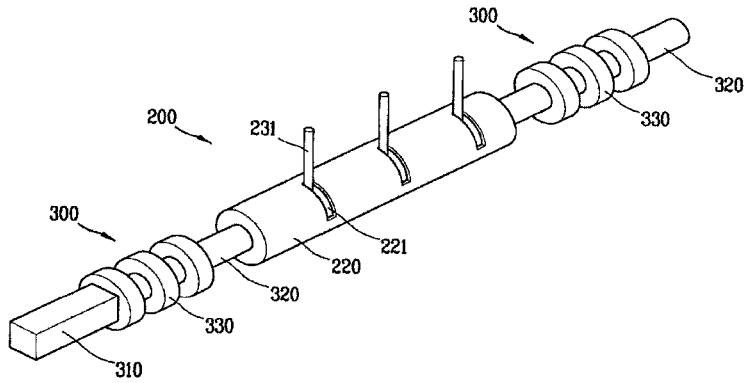
FIG. 8 is a perspective view showing a state that two damper assemblies are coupled to each other with a hinge assembly interposed therebetween.

FIG. 7 is a perspective view showing a state that two hinge assemblies are coupled to each other with a damper assembly interposed therebetween, and FIG. 8 is a perspective view showing a state that two damper assemblies are coupled to each other with a hinge assembly interposed therebetween.

More concretely, FIG. 7 shows a structure of 'hinge assembly-damper assembly-hinge assembly' and FIG. 8 shows a structure of 'damper assembly-hinge assembly-damper assembly'.

Here, various combinations rather than the structures shown in FIGS. 7 and 8 may be implemented. The hinge assemblies 200 and the damper assemblies 300 may be variously combined to one another on the same shaft, thus to be mounted to a connection part between the door 140 and the top cover 120 of the washing machine 100.

Furthermore, the hinge assembly 200 and the damper assembly 300 may be provided to obtain a sufficient damping force required to attenuate an impact occurring when the door 140 is closed.

The invention claimed is:

1. A washing machine, comprising:

a casing;

a top cover installed on an upper surface of the casing;

a door installed at the top cover, through which inside of the casing is opened and closed; and a hinge assembly configured to provide a damping force when the door is opened and closed, the hinge assembly comprising:

a first hinge portion insertion-fixed to the top cover; and a second hinge portion extending from the first hinge portion, the second hinge portion being formed in a cylindrical shape and having a cavity therein, the second hinge portion provided with slots extending along a circumferential direction so as to have a length corresponding to an open state and a closed state of the door, respectively, to determine a range of motion of the door, and provided with spring fixing holes spaced from the slots, the second hinge portion being rotatably inserted into the door so that the door pivots on the second hinge portion between the open and closed states; and a torsion spring inserted into the cavity of the second hinge portion;

wherein one end of the torsion spring is fixedly coupled to the door through one of the slots, and another end thereof is insertion-fixed to one of the spring fixing holes.

2. The washing machine of claim 1, further comprising a plurality of torsional springs.

3. The washing machine of claim 1, wherein one end of the torsion spring, having been inserted through the slot, moves along the slot when the door is opened and closed.

4. A washing machine, comprising:

a casing;

a top cover installed on an upper surface of the casing;

a door installed at the top cover, through which inside of the casing is opened and closed;

a hinge assembly configured to provide a damping force when the door is opened and closed, the hinge assembly comprising:

a first hinge portion insertion-fixed to the top cover; and a second hinge portion extending from the first hinge portion and the second hinge portion rotatably inserted into the door so that the door pivots on the second hinge portion, formed in a cylindrical shape having a torsion spring therein, provided with slots extending along a circumferential direction so as to have a length corresponding to an opened state and a closed state of the door, respectively, to determine a range of motion of the door, and provided with spring fixing holes spaced from the slots, wherein one end of the torsion spring is fixedly coupled to the door through one of the slots, and another end thereof is insertion-fixed to one of the spring fixing holes, and a damper assembly, the damper assembly comprising:

a first damper portion fixed to the top cover;

a second damper portion connected to the first damper portion, and inserted into the door; and a ring member having a round shape and fitted into an outer circumferential surface of the second damper portion, wherein the door is provided with an accommodating portion for accommodating the second damper portion and the ring member therein, and wherein the ring member is fitted into the accommodating portion of the door to generate a damping force by contacting the accommodating portion of the door.

5. The washing machine of claim 4, wherein the second damper portion has a circular sectional surface, whereas the first damper portion has a polygonal sectional surface.

6. The washing machine of claim 4, wherein the second damper portion has a circular or polygonal sectional surface, and wherein a central portion of the ring member has a circular or polygonal sectional surface in correspondence to the sectional shape of the second damper portion, and wherein the ring member has a circular outer circumference.

7. The washing machine of claim 4, further comprising a plurality of ring members.

8. The washing machine of claim 4, wherein the first damper portion of the damper assembly is inserted into the top cover, and the second damper portion is inserted into the door.

9. The washing machine of claim 4, wherein the hinge assembly and the damper assembly are coupled to each other on a same shaft.

10. The washing machine of claim 9, further comprising a plurality of hinge assemblies and damper assemblies, wherein each hinge assembly is coupled to a damper assembly.

11. The washing machine of claim 4, wherein the ring member is formed of polyurethane or rubber.

* * * * *